US009586775B2

(12) United States Patent
Hosohara

(10) Patent No.: US 9,586,775 B2
(45) Date of Patent: Mar. 7, 2017

(54) SHEET FEEDING APPARATUS AND IMAGE FORMING APPARATUS

(71) Applicant: CANON KABUSHIKI KAISHA, Tokyo (JP)

(72) Inventor: Kazuhiro Hosohara, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/955,570

(22) Filed: Dec. 1, 2015

(65) Prior Publication Data

US 2016/0152426 A1 Jun. 2, 2016

(30) Foreign Application Priority Data

Dec. 2, 2014 (JP) ..... 2014-244172

(51) Int. Cl.

| | |
|---|---|
| ***B65H 1/12*** | (2006.01) |
| ***B65H 3/06*** | (2006.01) |
| ***B65H 3/56*** | (2006.01) |
| ***B65H 3/52*** | (2006.01) |
| *G03G 15/00* | (2006.01) |

(52) U.S. Cl.

CPC ..... *B65H 3/0669* (2013.01); *B65H 1/12* (2013.01); *B65H 3/0607* (2013.01); *B65H 3/5215* (2013.01); *B65H 3/5261* (2013.01); *B65H 3/56* (2013.01); *G03G 15/6511* (2013.01); *B65H 3/5223* (2013.01); *B65H 2403/514* (2013.01); *B65H 2403/721* (2013.01); *B65H 2404/144* (2013.01); *B65H 2404/1441* (2013.01); *B65H 2405/11162* (2013.01); *B65H 2513/512* (2013.01); *B65H 2513/514* (2013.01); *B65H 2601/521* (2013.01); *G03G 15/6529* (2013.01); *G03G 2221/1657* (2013.01)

(58) Field of Classification Search

CPC ..... B65H 2403/721; B65H 2403/514; B65H 3/0669; B65H 3/0607; B65H 1/12; B65H 3/56; B65H 2405/11162; B65H 3/5261; B65H 3/5223

See application file for complete search history.

(56) References Cited

U.S. PATENT DOCUMENTS

| | | | | |
|---|---|---|---|---|
| 6,953,190 | B2 * | 10/2005 | Shin | B65H 1/12 271/157 |
| 7,862,032 | B2 * | 1/2011 | Taniguchi | B65H 3/0607 271/110 |
| 8,646,904 | B2 * | 2/2014 | Sakano | B65H 3/0684 271/4.1 |
| 8,888,091 | B2 * | 11/2014 | Hosohara | B65H 3/06 271/118 |
| 2006/0180990 | A1 * | 8/2006 | Ueda | B65H 3/0623 271/121 |

(Continued)

FOREIGN PATENT DOCUMENTS

| | | |
|---|---|---|
| JP | 1-123772 A | 5/1989 |
| JP | 2000-344368 A | 12/2000 |

(Continued)

*Primary Examiner* — Jeremy R Severson

(74) *Attorney, Agent, or Firm* — Canon USA, Inc., IP Division

(57) ABSTRACT

In a sheet feeding apparatus without increase in size and without fluctuation in sheet feeding interval, a clutch is brought into a disconnected state after a separation roller separates from a feed roller.

15 Claims, 13 Drawing Sheets

(56) References Cited

U.S. PATENT DOCUMENTS

| | | | | |
|---|---|---|---|---|
| 2015/0028537 | A1* | 1/2015 | Hosohara | B65H 3/06 271/147 |
| 2015/0084267 | A1* | 3/2015 | Hosohara | B65H 1/14 271/110 |
| 2015/0286181 | A1* | 10/2015 | Koyama | B65H 9/004 399/388 |
| 2015/0321862 | A1* | 11/2015 | Song | B65H 3/0684 271/117 |
| 2016/0159591 | A1* | 6/2016 | Takase | B65H 3/0607 271/121 |

FOREIGN PATENT DOCUMENTS

| | | | |
|---|---|---|---|
| JP | 2002-255377 | A | 9/2002 |
| JP | 2003-201032 | A | 7/2003 |
| JP | 2013-189311 | A | 9/2013 |

* cited by examiner

SHEET FEEDING APPARATUS AND IMAGE FORMING APPARATUS

BACKGROUND OF THE INVENTION

Field of the Invention

The present invention relates to a sheet feeding apparatus and an image forming apparatus having the sheet feeding apparatus.

Description of the Related Art

A conventional image forming apparatus for forming an image on a sheet is provided with a sheet feeding apparatus for feeding a sheet by moving a stacking plate having stacked sheets thereon up and down to bring the top sheet into contact with a feed roller. Such a sheet feeding apparatus is known to have a configuration in which the stacking plate is moved up and down with a rotating cam to move the sheets stacked on the stacking plate between a position urged to the feed roller and a position separated from the feed roller.

Further, a conventional sheet feeding apparatus has a configuration in which a separating member for separating each of fed sheets is moved from a contact position to a separated position after a fed sheet reaches a roller next to the separating member.

Japanese Patent Application Laid-Open No. 1-123772 discusses a configuration having a clutch for turning a driving force transmission to a feed roller ON (transmitted) and OFF (untrasmitted).

However, Japanese Patent Application Laid-Open No. 1-123772 does not discuss a relation between the timing when a separating member is moved to a separated position and the timing when driving force transmission to the feed roller is turned OFF by the clutch. Turning the clutch OFF in a state where the separating member is positioned at a contact position may cause an increase in an operation sound.

SUMMARY OF THE INVENTION

The present invention is directed to a sheet feeding apparatus producing a reduced operation sound.

According to an aspect of the present invention, a sheet feeding apparatus includes, a sheet feeding device configured to feed a sheet, a separating member movably provided between a contact position where the separating member is in contact with the sheet feeding device and a separated position where the separating member is separated from the sheet feeding device, and configured to separate sheets, a first moving device configured to move the separating member between the contact position and the separated position, a driving device configured to generate a driving force, and a clutch unit configured to change a transmission state of the driving force from the driving device to the sheet feeding device between a first state where the driving force is transmitted and a second state where the driving force is not transmitted. After the first moving device moves the separating member from the contact position to the separated position, the clutch unit changes the transmission state of the driving force from the driving device to the sheet feeding device to the second state.

Further features of the present invention will become apparent from the following description of exemplary embodiments with reference to the attached drawings.

DESCRIPTION OF THE EMBODIMENTS

An exemplary embodiment of the present invention will be described below with reference to the accompanying drawings.

Figure 1A:
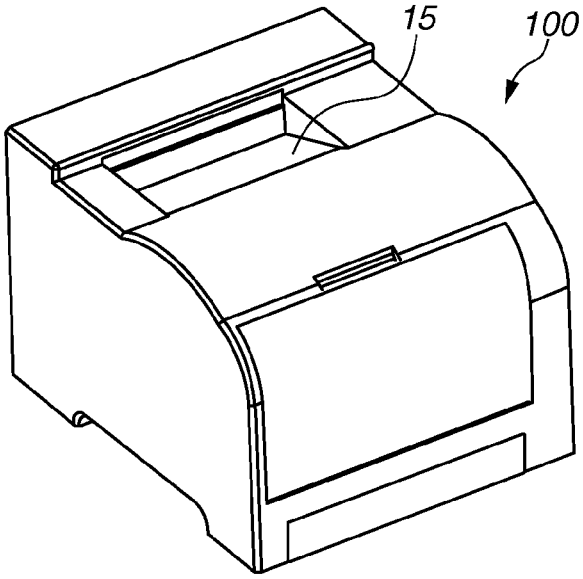
FIGS. 1A and 1B illustrate an overall configuration of an image forming apparatus according to an exemplary embodiment of the present invention.
Figure 1B:
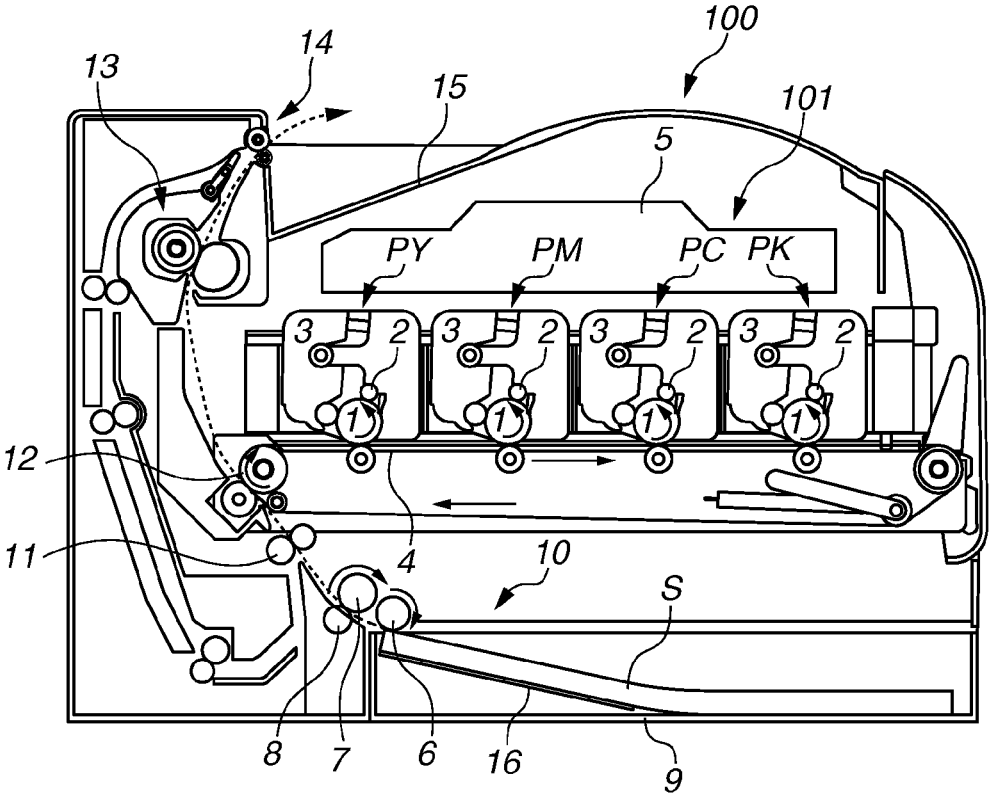

FIGS. 1A and 1B illustrate a color digital printer as an example of an image forming apparatus to which a sheet feeding apparatus according to an exemplary embodiment is applied. FIG. 1A is a perspective view illustrating an outer appearance of an image forming apparatus 100. FIG. 1B is a cross sectional view schematically illustrating the image forming apparatus 100. The image forming apparatus 100 is a 4-color full color laser beam printer employing the electrophotographic process. More specifically, based on an image signal input to a controller unit (control unit) from an external host device such as a personal computer, an image reader, and a partner facsimile apparatus, an image is formed on a sheet (recording medium) S.

An image forming operation performed by the image forming unit 101 will be described below. A drum 1 in each of four cartridges PY, PM, PC, and PK rotates in the counterclockwise direction indicated by the arrow at a predetermined control speed. A belt 4 is rotatably driven in the clockwise direction (the forward direction of the drum rotation) indicated by the arrow at a speed corresponding to the rotational speed of the drum 1. A scanner unit 5 is also driven.

In synchronization with this drive, a charging roller 2 in each cartridge uniformly charges the surface of the drum 1 to a predetermined polarity and a predetermined potential at a predetermined control timing. The scanner unit 5 performs scanning exposure on the surface of each drum 1 with laser light modulated with an image signal for each color.

On the surface of each drum 1, areas on which scanning exposure is performed with laser light form an electrostatic latent image corresponding to the image signal. The electrostatic latent image formed on the surface of each drum 1 is developed as a toner image by a developing unit 3. A toner image is formed on each drum 1 through the above-described electrophotographic image forming process, and then is primarily transferred onto the belt 4.

A feeding cassette 9 is configured to be detachably attached to the front face of the image forming apparatus 100 (the side on which an operator performs operations, i.e., the right-hand side of the image forming apparatus 100 illustrated in FIG. 1B) so that a user is able to easily set sheets and perform a jam recovery operation.

A pickup roller 6, as a sheet feeding device, contacts a sheet stacked on a stacking plate (stacking unit) 16 of the feeding cassette 9 to feed the sheet. The sheet fed by the pickup roller 6 is further separately fed by a feed roller 7 and a separation roller (separating member) 8, passes through a registration roller pair 11, and then is conveyed to a secondary transfer nip portion between a secondary transfer roller 12 and the belt 4. The separation roller 8 is attached to a sheet feeding guide 34 (refer to FIG. 2) via a separation roller holder 40 and a separation nip guide holder 43 (refer to FIGS. 8 and 9A, respectively), and is brought into pressure contact with the feed roller 7 via a separation roller spring 41 serving as an urging unit. The present invention should not be limited to the separation roller 8, and a separation pad and a retard roller may be used. More specifically, the present invention may use a separating member for separating sheets one by one if a plurality of sheets is fed together.

The sheet on which the toner image is transferred at the secondary transfer nip portion is heated and pressurized by a fixing unit 13, thus fixing the toner image thereon. The sheet on which the toner image is fixed is discharged onto a discharge tray 15 by a discharge roller pair 14.

Figure 2:
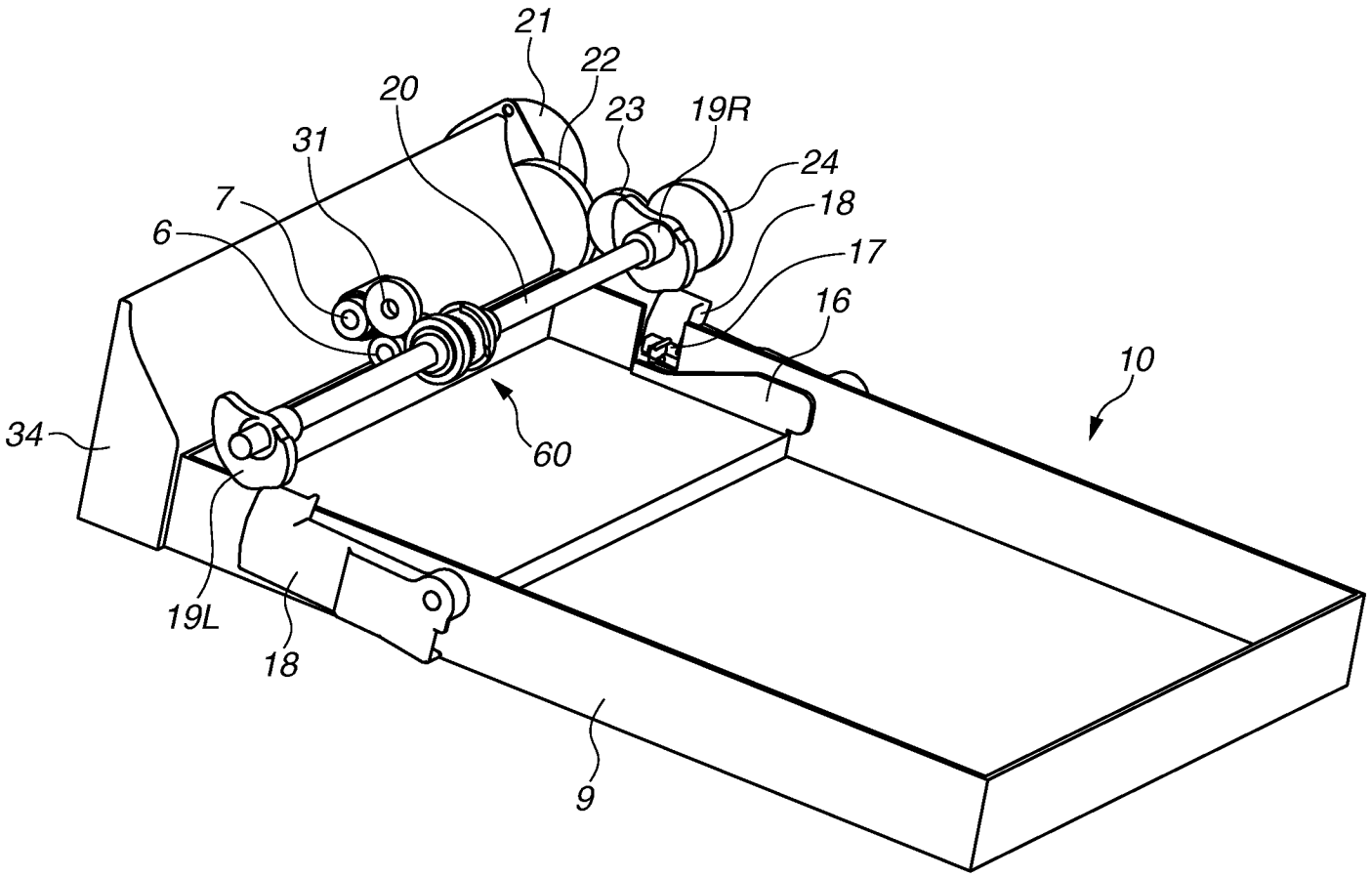
FIG. 2 illustrates a sheet feeding apparatus according to an exemplary embodiment of the present invention.

The sheet feeding apparatus will be described below. FIG. 2 is a perspective view schematically illustrating a sheet feeding apparatus 10. The stacking plate 16 on which sheets are stacked can be moved up and down.

Figure 3:
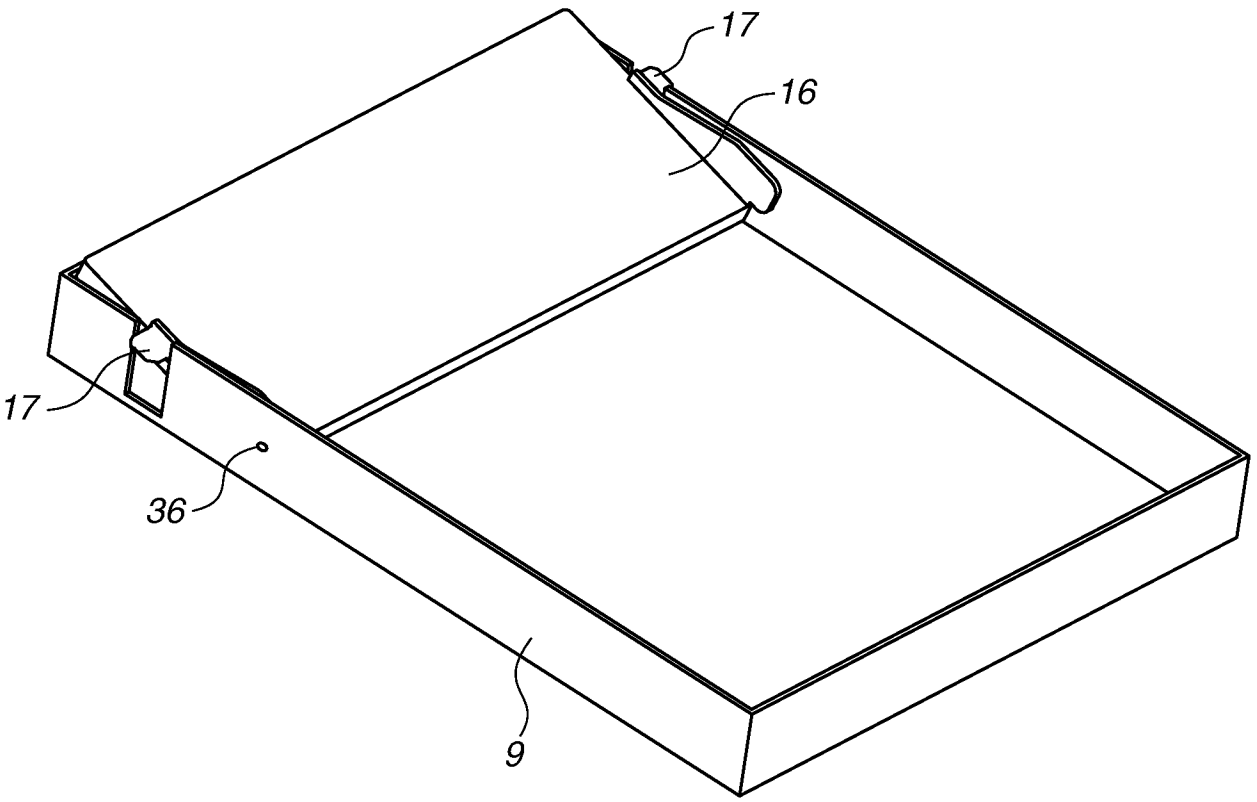
FIG. 3 is a perspective view schematically illustrating a feeding cassette.
Figure 4A:
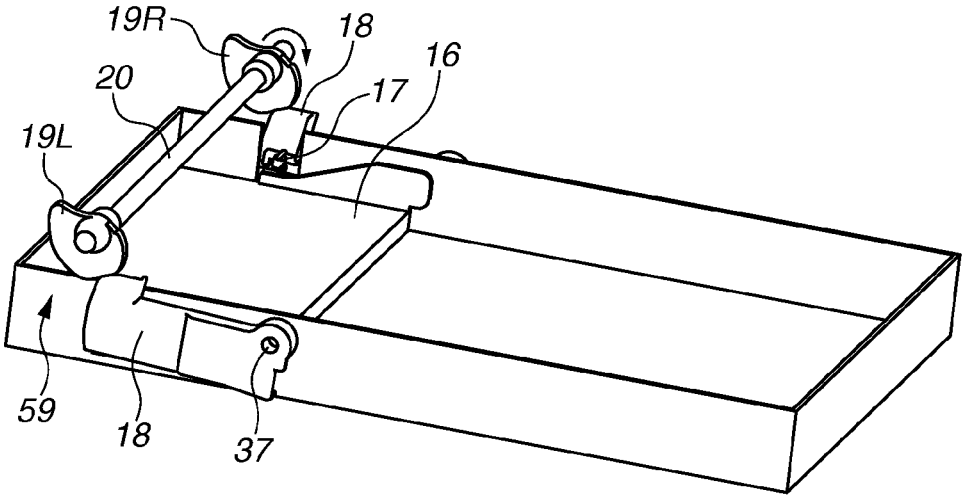
FIGS. 4A and 4B illustrate an elevation device for moving a stacking plate up and down.
Figure 4B:
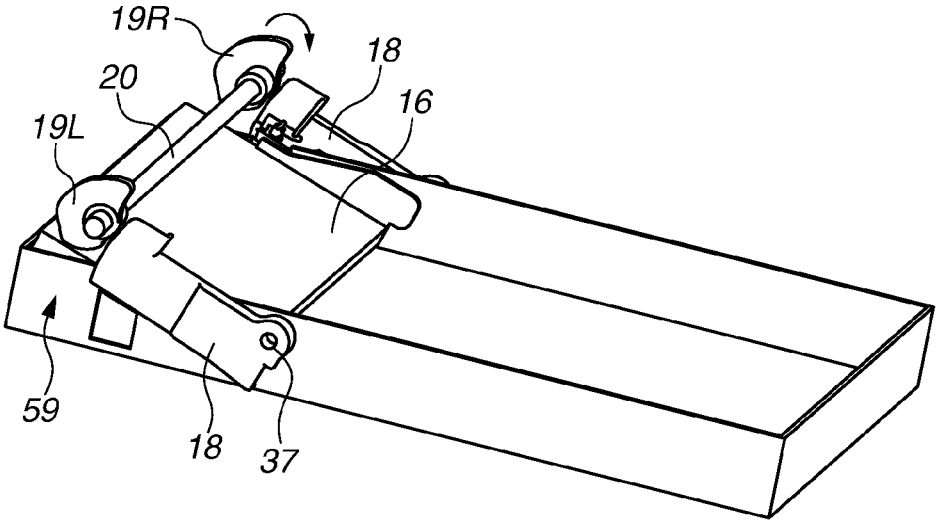

Up/down operations of the stacking plate 16 will be described below with reference to FIGS. 3 and 4. FIG. 3 is a perspective view schematically illustrating the feeding cassette 9. FIG. 4A is a perspective view schematically illustrating a state where the stacking plate 16 according to the present exemplary embodiment is moved down. FIG. 4B is a perspective view schematically illustrating a state of the stacking plate 16 according to the present exemplary embodiment is moved up.

As illustrated in FIG. 3, the stacking plate 16 is rotatably positioned around stacking plate rotation supporting portions 36 as a rotational center. The stacking plate 16 is moved up and down by an elevation device (stacking unit elevation device) 59. The elevation device 59 moves the stacking plate 16 up to urge the stacked sheets to the pickup roller 6, and moves the stacking plate 16 down to separate the stacked sheets from the pickup roller 6.

Even when a small amount of sheets is stacked on the stacking plate 16, the elevation device 59 moves the stacking plate 16 up until the sheet is sufficiently urged to the pickup roller 6.

As illustrated in FIGS. 4A and 4B, the elevation device 59 is provided with elevation levers 18, elevation lever rotation supporting portions 37, elevation cams 19 (19L and 19R), and a connecting shaft 20 for connecting the left elevation cam 19L and the right elevation cam 19R.

The elevation levers 18 are provided on both sides of the feeding cassette 9, and are rotatably fixed on the housing of the image forming apparatus 100 around the elevation lever rotation supporting portions 37 as a rotational center. The elevation levers 18 are urged in the direction for approaching the pickup roller 6 (upward direction) by urging members such as springs (not illustrated). Engaging portions 17 engaging with the elevation levers 18 are formed on both ends of the stacking plate 16. In a state where the feeding cassette 9 is attached to and positioned on the image forming apparatus 100, the engaging portions 17 engage with the elevation levers 18, and the stacking plate 16 moves up and down in conjunction with the rotation of the elevation levers 18. The rotation of the elevation levers 18 urged in the direction for approaching the pickup roller 6 is restricted by the elevation cams 19 (19L and 19R) disposed above the elevation levers 18. As illustrated in FIGS. 4A and 4B, when the connecting shaft 20 is rotated by a driving force received from a driving device (described below), the elevation cams 19 (19L and 19R) rotate to rotatably move the elevation levers 18 up and down. Accordingly, the stacking plate 16 moves up and down via the engaging portions 17.

Figure 5:
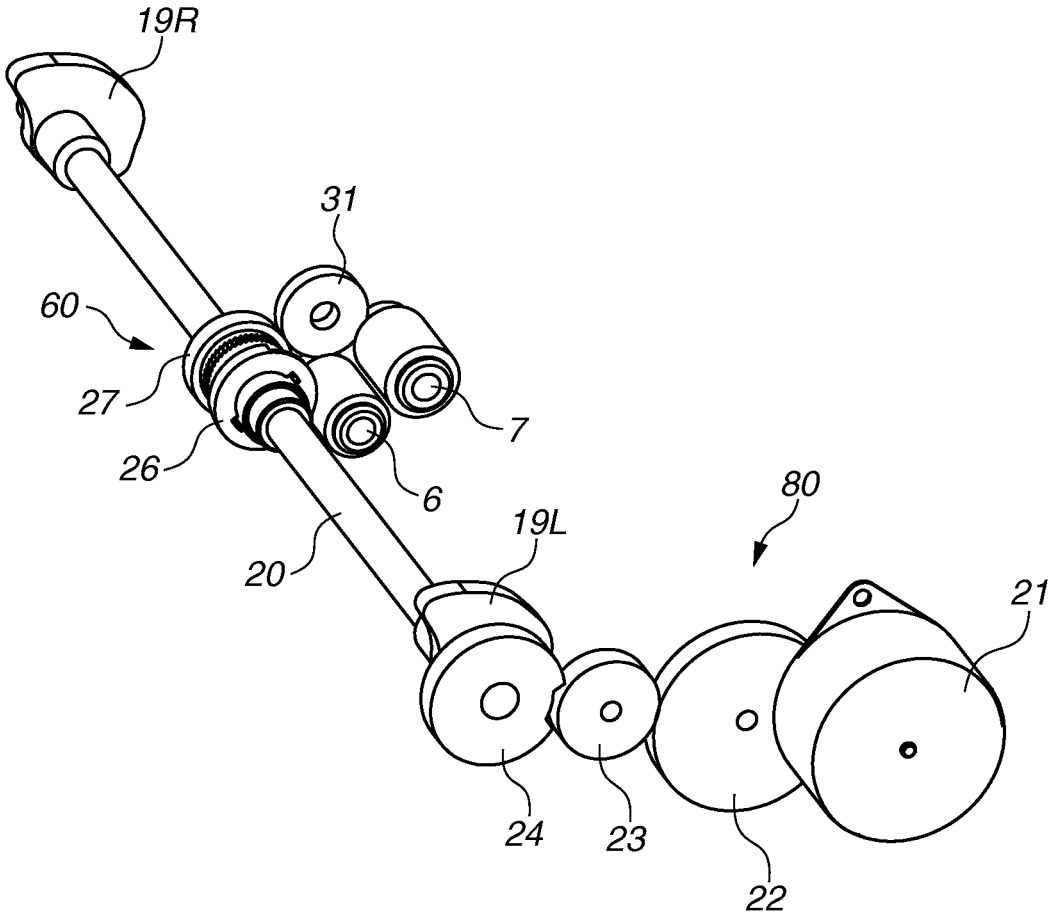
FIG. 5 illustrates a drive transmission path from a driving source.

A driving device 80 will be described below with reference to FIG. 5. The driving device 80 transmits a driving force to the elevation device 59 to move the stacking plate 16 up and down. The driving device 80 further rotates the pickup roller 6 via a drive transmission unit.

A driving source 21 is, for example, a motor of the driving device 80 provided in the main body of the image forming apparatus 100. A driving force generated by the driving source 21 is transmitted from a first drive gear 22 to a second drive gear 23 and then from the second drive gear 23 to a partially-toothless gear 24. The partially-toothless gear 24 is configured to be regulated and deregulated by a solenoid (not illustrated) to selectively engage with the second drive gear 23. When the solenoid deregulates the partially-toothless gear 24, the partially-toothless 24 engages with the second drive gear 23. Accordingly, a driving force is transmitted to the partially-toothless gear 24 and the partially-toothless gear 24 starts to rotate. When the partially-toothless gear 24 rotates once, the solenoid regulates the partially-toothless gear 24 at a position where the partially-toothless portion of the partially-toothless gear 24 faces the second drive gear 23. Accordingly, the drive transmission is disconnected.

The partially-toothless gear 24 and the elevation cams 19 (19L and 19R) are fixed to the connecting shaft 20 rotatably supported by the main body of the image forming apparatus 100, and configured to rotate integrally with the connecting shaft 20. When the solenoid operates based on an electrical signal from the control unit (not illustrated) to deregulate the partially-toothless gear 24, the partially-toothless gear 24 engages with the second drive gear 23. Then, the driving force of the driving source 21 is transmitted to the connecting shaft 20 via the partially-toothless gear 24, and the connecting shaft 20 rotates once together with the elevation cams 19 (19L and 19R).

An idler gear 31 as a drive transmission unit transmits a driving force to the pickup roller 6 and the feed roller 7 via the clutch unit 60. A tooth plane is formed on each of the pickup roller 6 and the feed roller 7 to engage with the idler gear 31. Each of the pickup roller 6 and the feed roller 7 is driven to rotate by receiving the rotation of the idler gear 31.

A clutch input gear 26 serves as a clutch input unit, and a clutch output gear 27 serves as a clutch output unit. The clutch input gear 26 rotates by a driving force input from the driving device 80. The clutch output gear engages (connects)

with the clutch input gear 26 to transmit the driving force from the driving device 80 to the pickup roller 6. The clutch output unit idler gear 31 is disposed to engage with the clutch output gear 27. Therefore, in a state where the clutch input gear 26 is engaged with the clutch output gear 27, the rotation of the connecting shaft 20 is transmitted to the idler gear 31, thereby rotating the pickup roller 6 and the feed roller 7. In a state where the clutch input gear 26 is not engaged (disconnected) with the clutch output gear 27, the rotation of the connecting shaft 20 is not transmitted to the idler gear 31.

When the connecting shaft 20 rotates once, the pickup roller 6 and the feed roller 7 also rotate. The sheet conveyance distance produced by this rotation is set to a distance that allows a sheet to be conveyed to the registration roller pair (conveyance unit) 11 on the downstream side.

The clutch unit 60 will be described in detail below. After the elevation device 59 moves the stacking plate 16 up and then the stacked sheet comes into pressure contact with the pickup roller 6, the clutch input gear 26 of the clutch unit 60 engages with the clutch output gear 27. Since the rotation of the pickup roller 6 is started after the sheet stacked on the stacking plate 16 comes into pressure contact with the pickup roller 6, the interval of sheet feeding does not fluctuate. Even if the number of sheets stacked on the stacking plate 16 changes and a time lag occurs in the timing of contact between the sheet and the pickup roller 6, the sheet feed timing of the pickup roller 6 is fixed regardless of the amount of stacked sheets.

Figure 6:
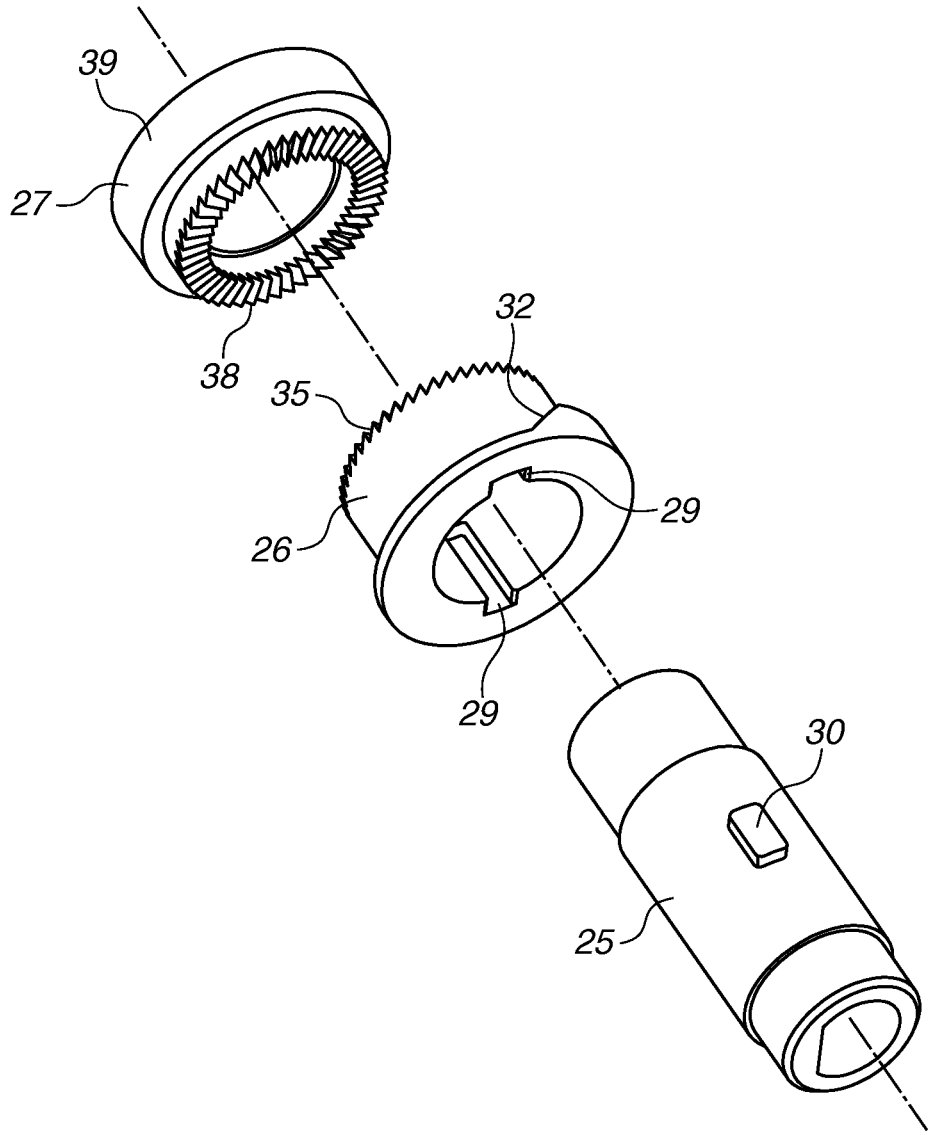
FIG. 6 is a perspective view schematically illustrating a clutch unit.
Figure 7A:
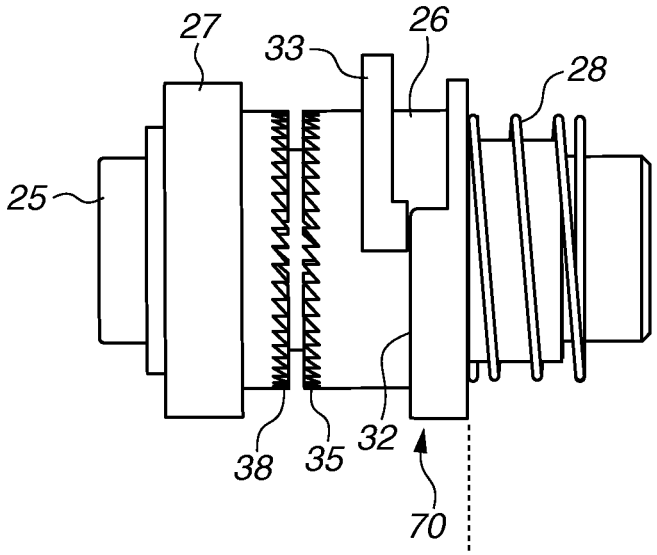
FIGS. 7A, 7B, and 7C illustrate connecting and disconnecting operations of the clutch unit.
Figure 7B:
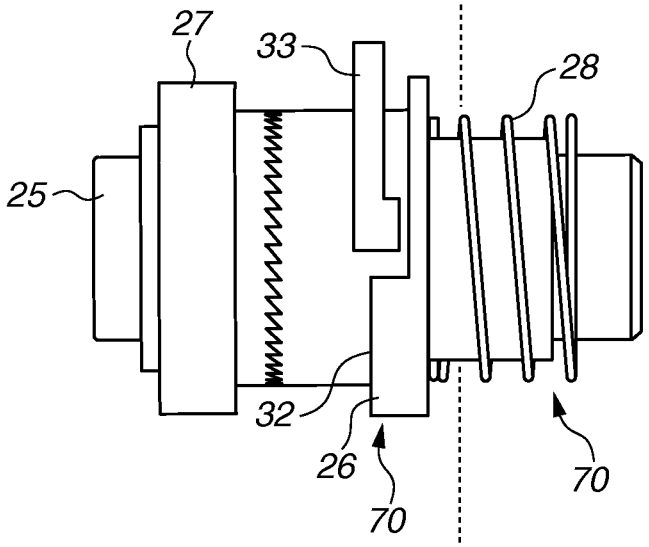
Figure 7C:
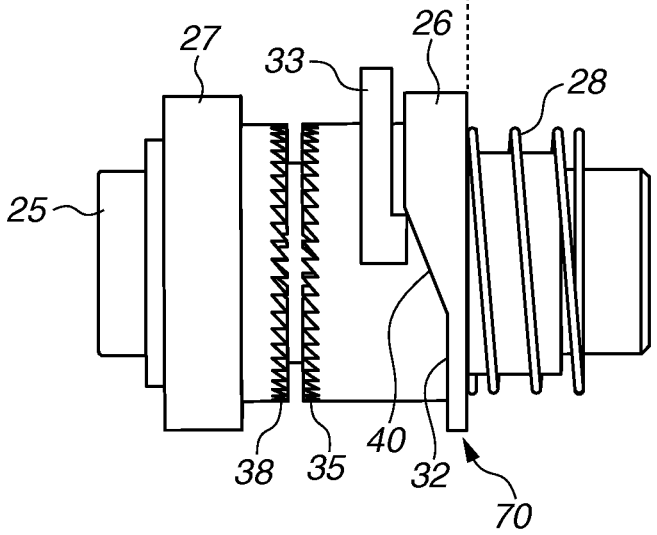

FIG. 6 is a perspective view schematically illustrating the clutch unit according to the present exemplary embodiment. FIG. 7A is a schematic view illustrating a state where the clutch unit is disconnected (i.e., a driving force is untransmittable). FIG. 7B is a schematic view illustrating a state where the clutch unit is connected (i.e., a driving force is transmittable). FIG. 7C is a schematic view illustrating a state where the clutch unit changes from the connected state to the disconnected state.

As illustrated in FIG. 6, the clutch bearing 25 is fixed to the connecting shaft 20 and rotates integrally with the connecting shaft 20. A key 30 is formed on the clutch bearing 25. A key groove 29, a cam plane 32, and an input side gear tooth plane 35 are formed on the clutch input gear 26. When the key 30 of the clutch bearing 25 engages with the key groove 29, the clutch input gear 26 is held by the clutch bearing 25. In this state, the clutch input gear 26 is fixed in the rotational direction of the clutch bearing 25, and is movable in the longitudinal direction (the direction of the rotating shaft center) of the connecting shaft 20. The clutch output gear 27 is provided with a tooth plane 39 engaging with the idler gear 31, and an output side gear tooth plane 38, and is rotatably held by the clutch bearing 25. Both ends in the longitudinal direction of the connecting shaft 20 of the clutch output gear 27 is fixed to the main body of the image forming apparatus 100. As illustrated in FIG. 7A, the clutch input gear 26 is urged by a clutch pressing spring 28 as an elastic member for urging toward the clutch output gear 27.

Connecting and disconnecting operations of the clutch unit 60 will be described below with reference to FIGS. 7A, 7B, and 7C.

As illustrated in FIG. 7A, in a state where the cam plane 32 provided on the clutch input gear 26 is latched by a clutch regulation rib 33 provided on the main body of the image forming apparatus 100, the input side gear tooth plane 35 of the clutch input gear 26 separates from the output side gear tooth plane 38 of the clutch output gear 27. A driving force is not transmitted in this state where the clutch unit 60 is disconnected.

As illustrated in FIG. 7B, when the input side gear tooth plane 35 of the clutch input gear 26 engages with the output side gear tooth plane 38 of the clutch output gear 27, the clutch unit 60 is brought into the connected state. In a state where the clutch unit 60 is connected, a driving force is transmitted from the connecting shaft 20 to the pickup roller 6 and the feed roller 7 via the idler gear 31. In this way, the clutch unit 60 changes between the connected state and the disconnected state by the cam plane 32 rotating integrally with the connecting shaft 20, and the clutch regulation rib 33.

When the connecting shaft 20 rotates in the disconnected state of the clutch unit 60 illustrated in FIG. 7A, the clutch bearing 25 fixed to the connecting shaft 20 rotates, and the clutch input gear 26 also rotates via the key groove 29 and the key 30. The clutch regulation rib 33 is fixed to the main body of the image forming apparatus 100. Therefore, when the clutch input gear 26 rotates, the relative positional relation between the clutch regulation rib 33 and the cam plane 32 changes.

When the clutch input gear 26 rotates by a predetermined amount, the cam plane 32 is deregulated by the clutch regulation rib 33. Then, the urging force of the clutch pressing spring 28 brings the input side gear tooth plane 35 of the clutch input gear 26 into contact with the output side gear tooth plane 38 of the clutch output gear 27, resulting in the connected state illustrated in FIG. 7B.

A slope plane 40 is formed on the cam plane 32. When the clutch input gear 26 further rotates, the slope plane 40 runs onto the clutch regulation rib 33, as illustrated in FIG. 7C. Then, when the cam plane 32 is latched again by the clutch regulation rib 33, the input side gear tooth plane 35 and the output side gear tooth plane 38 are separated from each other.

When the connecting shaft 20 further rotates in the state illustrated in FIG. 7C, the state changes to the disconnected state illustrated in FIG. 7A. As described above, a clutch regulation device 70 provided with the clutch pressing spring 28, the cam plane 32, and the clutch regulation rib 33 moves the clutch input gear 26. The clutch regulation device 70 moves the clutch input gear 26 between the engaged position where the clutch input gear 26 engages with the clutch output gear 27 and the disengaged position where the clutch input gear 26 disengages with the clutch output gear 27. More specifically, the cam plane 32 and the clutch regulation rib 33 causes the movement mechanism 70 to move the clutch input gear 26 to a position along the axial direction of the connecting shaft 20 according to the rotational angle of the clutch input gear 26.

The elevation cams 19 (19L and 19R) and the clutch input gear 26 provided on the connecting shaft 20 rotate in synchronization with each other. The cam plane 32 of the movement mechanism 70 is formed so that, after the stacking plate 16 is moved up by the elevation cams 19 (19L and 19R) and the stacked sheet is urged to the pickup roller 6, the clutch input gear 26 is moved to the engaged position by the movement mechanism 70.

As described above, the clutch unit 60 changes the state of driving force transmission from the driving device 80 to the sheet feeding device (the pickup roller 6 and the feed roller 7) between a first state where the driving force is transmitted and a second state where the driving force is not transmitted.

Figure 8:
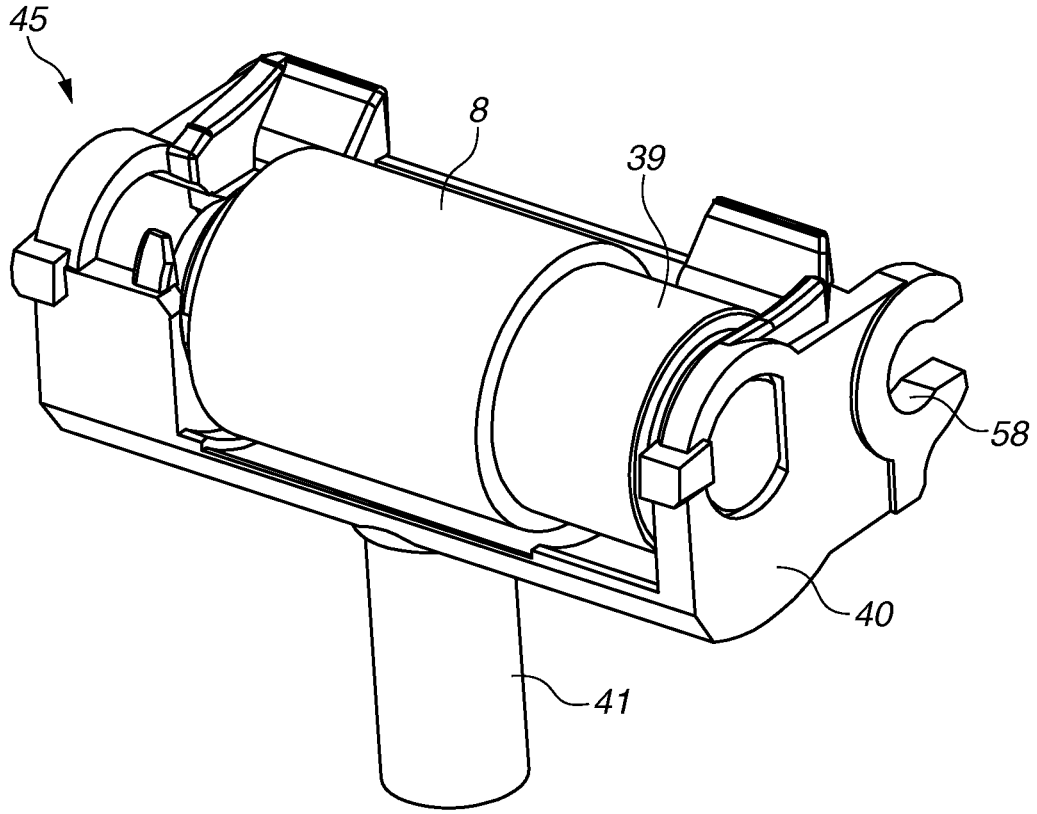
FIG. 8 is a schematic view illustrating a separation roller holder unit.
Figure 9A:
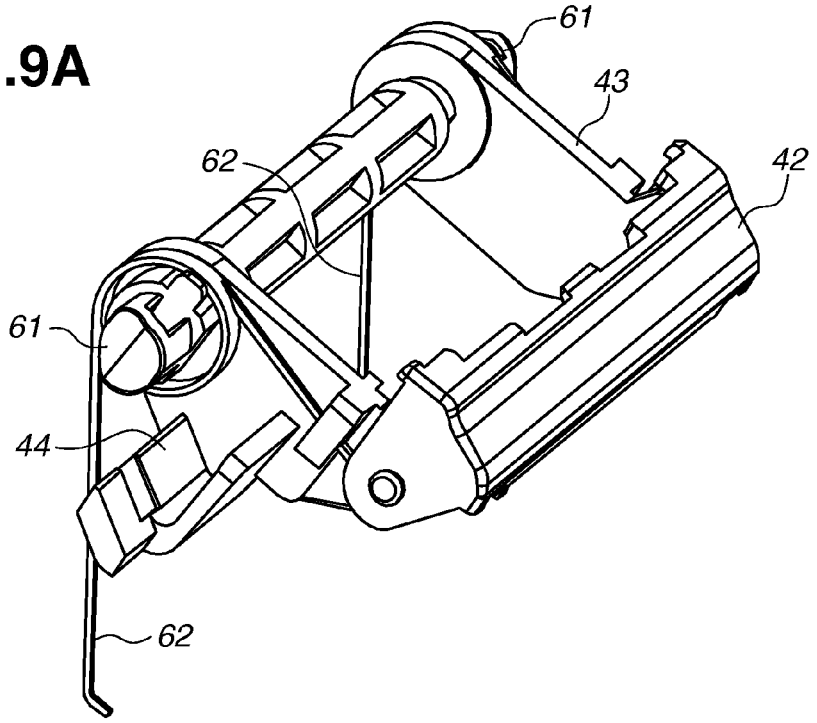
FIG. 9A is a perspective view schematically illustrating a separation nip guide unit before a separation roller is attached.
Figure 9B:
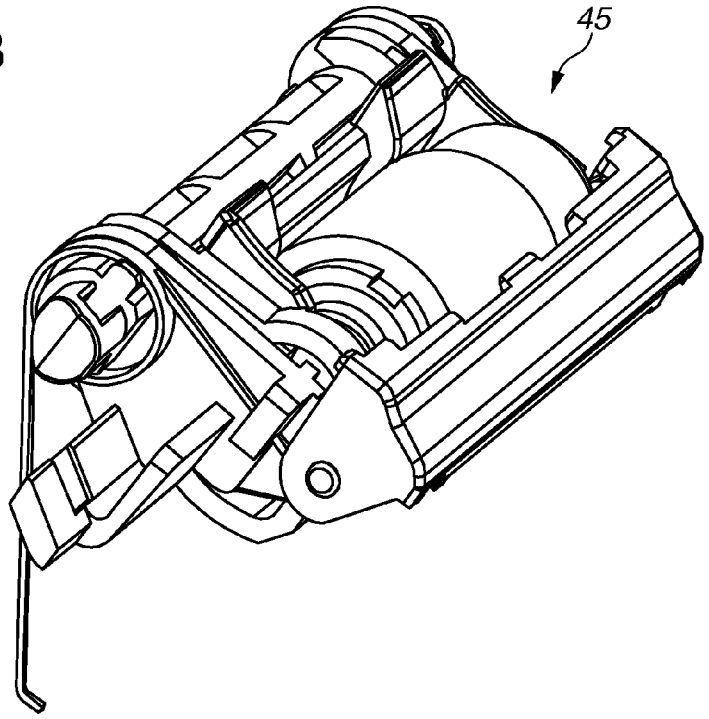
FIG. 9B is a perspective view schematically illustrating the separation nip guide unit after the separation roller is attached.

The configuration and a separation mechanism of the separation roller 8 will be described below with reference to FIGS. 8 and 9. The separation roller 8 includes a torque limiter portion 39 rotatably driven in the sheet feeding direction when predetermined torque is given, and is fixed to the separation roller holder 40 via the torque limiter portion 39. The separation roller holder (holding member) 40 is rotatably held by the separation nip guide holder 43 via separation roller holder engaging portions 58, and is urged toward the feed roller 7 by the separation roller spring 41 as an urging member. FIG. 9A is a perspective view schematically illustrating a separation nip guide unit before the separation roller 8 is attached thereto. FIG. 9B is a perspective view schematically illustrating the separation nip guide unit after the separation roller 8 is attached thereto. A separation nip guide 42 is provided to allow a sheet conveyed by the pickup roller 6 to smoothly enter a nip portion between the separation roller 8 and the feed roller 7, and is fixed to the tip of the separation nip guide holder 43. The separation nip guide holder 43 is rotatably held by the sheet feeding guide 34 via separation nip guide holder engaging portions 61 at both ends, and is urged in the direction for approaching the feed roller 7, together with the separation nip guide 42, by the separation nip guide spring 62. In this case, the setting of the urging force of the separation nip guide spring 62 is set to be sufficiently large with respect to the force received from the conveyed sheet by the separation nip guide 42. The separation nip guide holder 43 is provided with a position control surface 44 for controlling the position of the separation nip guide holder 43.

Figure 10B:
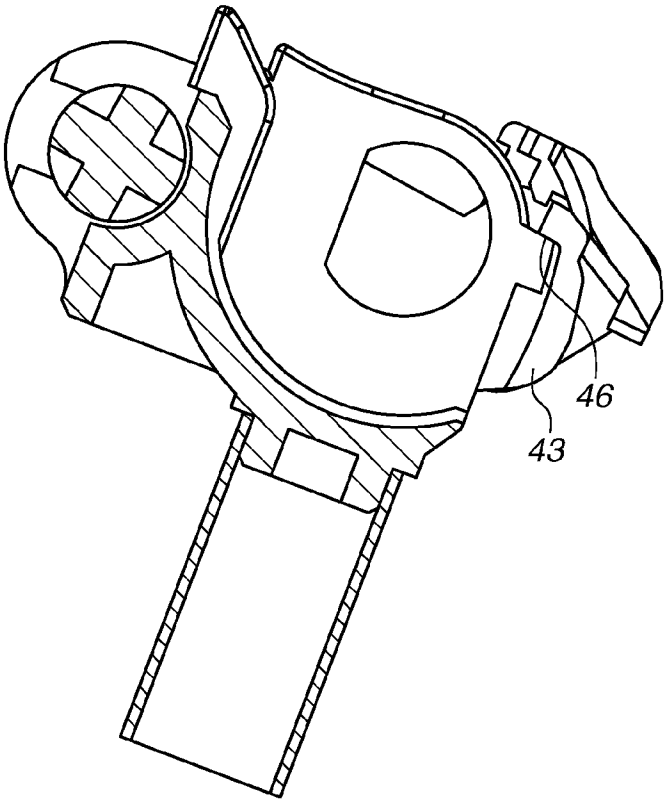
FIG. 10B is a cross sectional view schematically illustrating a state where the separation roller is separated from the feed roller.
Figure 10A:
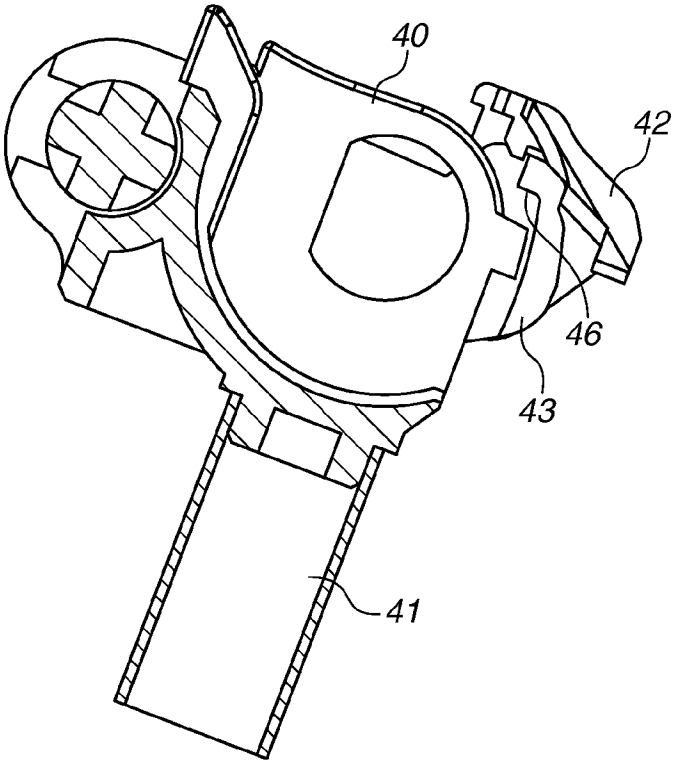
FIG. 10A is a cross sectional view schematically illustrating a state where the separation roller is in contact with a feed roller.

The positional relation between the separation roller holder 40 and the separation nip guide holder 43 will be described below with reference to FIGS. 10A, 10B, and 11. FIG. 10A is a cross sectional view schematically illustrating a state where the separation roller 8 is in contact with the feed roller 7. FIG. 10B is a cross sectional view schematically illustrating a state where the separation roller 8 is separated from the feed roller 7. In other words, the separation roller 8 is provided movably between a contact position where the separation roller 8 is in contact with the feed roller 7 and a separated position where the separation roller 8 is separated from the feed roller 7. In FIGS. 10A and 10B, the separation roller 8 is not illustrated to describe the positional relation between the separation roller holder 40 and the separation nip guide holder 43. During sheet feeding by the feed roller 7 and the separation roller 8, the separation roller holder 40 and the separation nip guide holder 43 are independently urged by the separation roller spring 41 and the separation nip guide spring 62, respectively, as illustrated in FIG. 10A. In this state, the position of the separation roller holder 40 is determined by the separation roller 8 and the feed roller 7 in contact with each other. On the other hand, the position of the separation nip guide holder 43 is determined when urged by the separation nip guide spring 62 until the separation nip guide holder 43 knocks a regulation unit (not illustrated) provided on the sheet feeding guide 34.

Figure 11A:
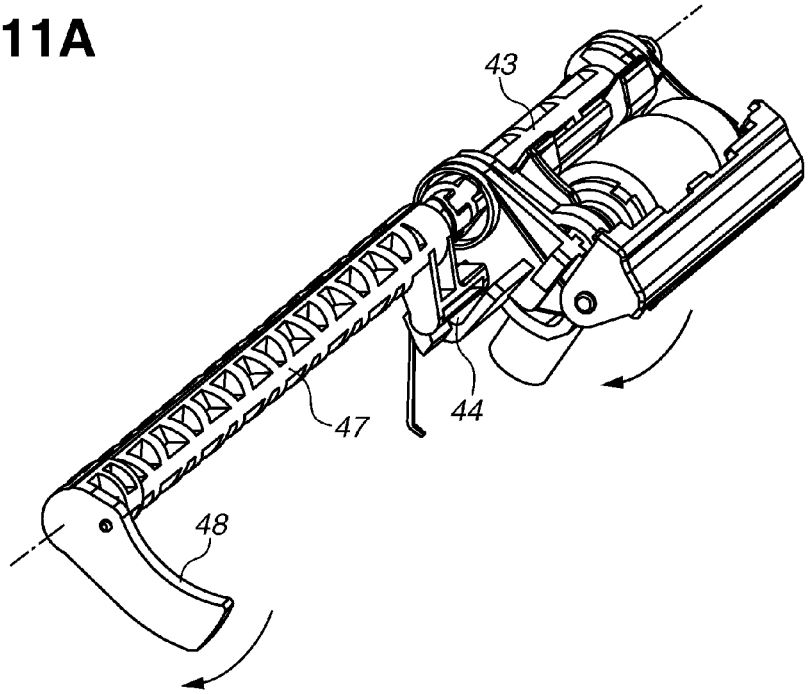
FIG. 11A is a schematic view illustrating a separation roller separating mechanism.
Figure 11B:
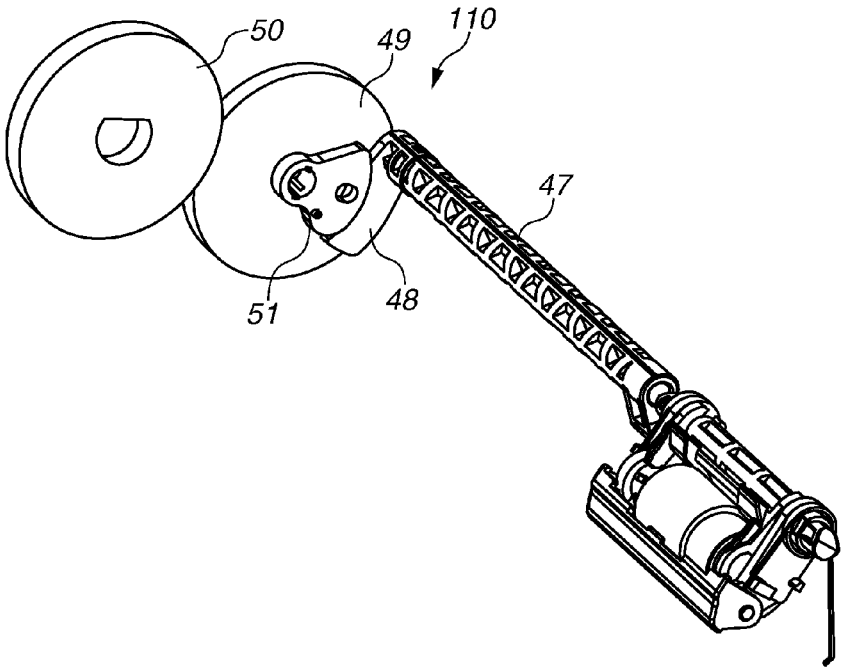
FIG. 11B is a schematic view illustrating the separation roller separating mechanism and a drive train.

A first moving device 110 for moving the separation roller 8 between a contact position and a separated position will be described below with reference to FIGS. 11A and 11B. Referring to FIG. 11A, a separation lever (separate member) 47 which contacts the position control surface 44 to control the position of the separation nip guide holder 43 is provided approximately coaxially on the rotational center of the separation nip guide holder 43 with respect to the sheet feeding guide 34. When the separation lever 47 rotates in the clockwise direction illustrated in FIG. 11A, the separation nip guide holder 43 also rotates in the clockwise direction via the position control surface 44. When the separation lever 47 rotates by a predetermined amount or more, a contact surface 46 for contacting the separation roller holder 40 provided on the separation nip guide holder 43 comes into contact with the separation roller holder 40, and the separation roller holder 40 is separated from the feed roller 7, together with the separation roller 8, resulting in a state illustrated in FIG. 10B. The rotation operation of the separation lever 47 is controlled by a separation lever cam plane 48 provided on the separation lever 47 and a separation control gear cam plane 51 provided on a separation control gear 49. When the lever cam plane 48 is pressed down by the separation control gear cam plane 51 against the urging force in the direction for approaching the feed roller 7 received from the separation roller spring 41 and the separation nip guide spring 62 by the separation nip guide holder 43, the separation lever 47 performs a rotation operation. Accordingly, when the separation control gear 49 rotates once, the separation lever 47 performs a reciprocating rotation operation once, during which the separation roller 8 comes into contact with and then separates from the feed roller 7. More specifically, in the first exemplary embodiment, the first moving device 110 for moving the separation roller 8 includes the separation lever 47, the lever cam plane 48, and the separation control gear cam plane 51. In the first exemplary embodiment, after the leading edge of the sheet reaches a registration roller 11 provided on the downstream side of the separation roller 8, the first moving device 110 causes the separation roller 8 to separate from the feed roller 7. This enables preventing the sheet conveyed by the registration roller 11 from receiving a back tension from the separation roller 8.

The separation control gear 49 is configured to receive a driving force transmitted from a connecting shaft gear 50 to rotate once as the connecting shaft gear 50 rotates once. The connecting shaft gear 50 is fixed to the connecting shaft 20, and is configured to rotate once, together with the elevation cam 19, as the connecting shaft rotates once. More specifically, the first moving device 110 causes the separation roller 8 to come into contact with and separate from the feed roller 7 by using the driving force of the driving device 80.

Figure 12:
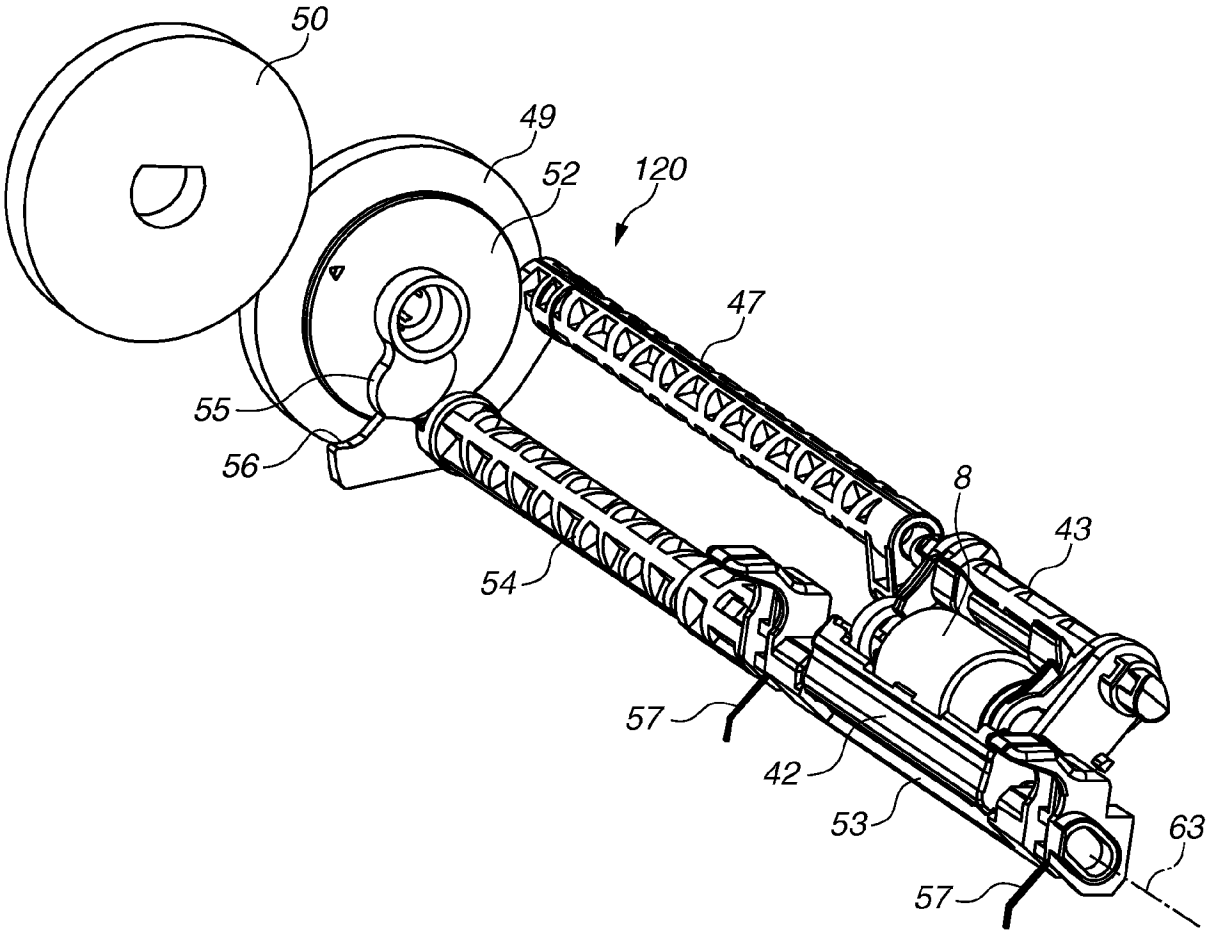
FIG. 12 is a schematic view illustrating an operation mechanism of a return claw.

The configuration of a return claw (protruded member) 53 will be described below with reference to FIG. 12. The return claw 53 prevents a sheet from being accidentally fed in a state where the separation roller 8 is separated from the feed roller 7. The return claw 53, together with a return claw control shaft 54, is rotatably held by the sheet feeding guide 34 around a return claw rotational center 63. The return claw 53 is provided at a position different from the separation roller 8 in a direction perpendicularly intersecting with the sheet feeding direction. A return claw control member 52 is fixed to the above-described separation control gear 49. A return claw control shaft cam plane 56 provided at an end of the return claw control shaft 54 is urged by a return claw urging spring 57 in the direction in which the return claw control shaft cam plane 56 comes into contact with a return claw control member cam plane 55. Therefore, when the separation control gear 49 rotates once together with the return claw control member 52, the return claw 53 performs a reciprocating rotation operation once around the return claw rotational center 63. In other words, the return claw 53 is provided movably between a protruded position where the return claw 53 is protruded to the sheet conveyance path between the pickup roller 6 and the separation roller 8 and a retracted position where the return claw 53 is retracted from the sheet conveyance path. A second moving device 120 including the return claw control member 52 and the return claw control member cam plane 55 moves the return claw 53 between the protruded position and the retracted position. The position where the return claw 53 is protruded is a position in the vicinity of a nip portion between the separation roller 8 and the feed roller 7 in the sheet feeding direction.

Sheet feeding operation timings of the sheet feeding apparatus 10 will be described below.

Figure 13:
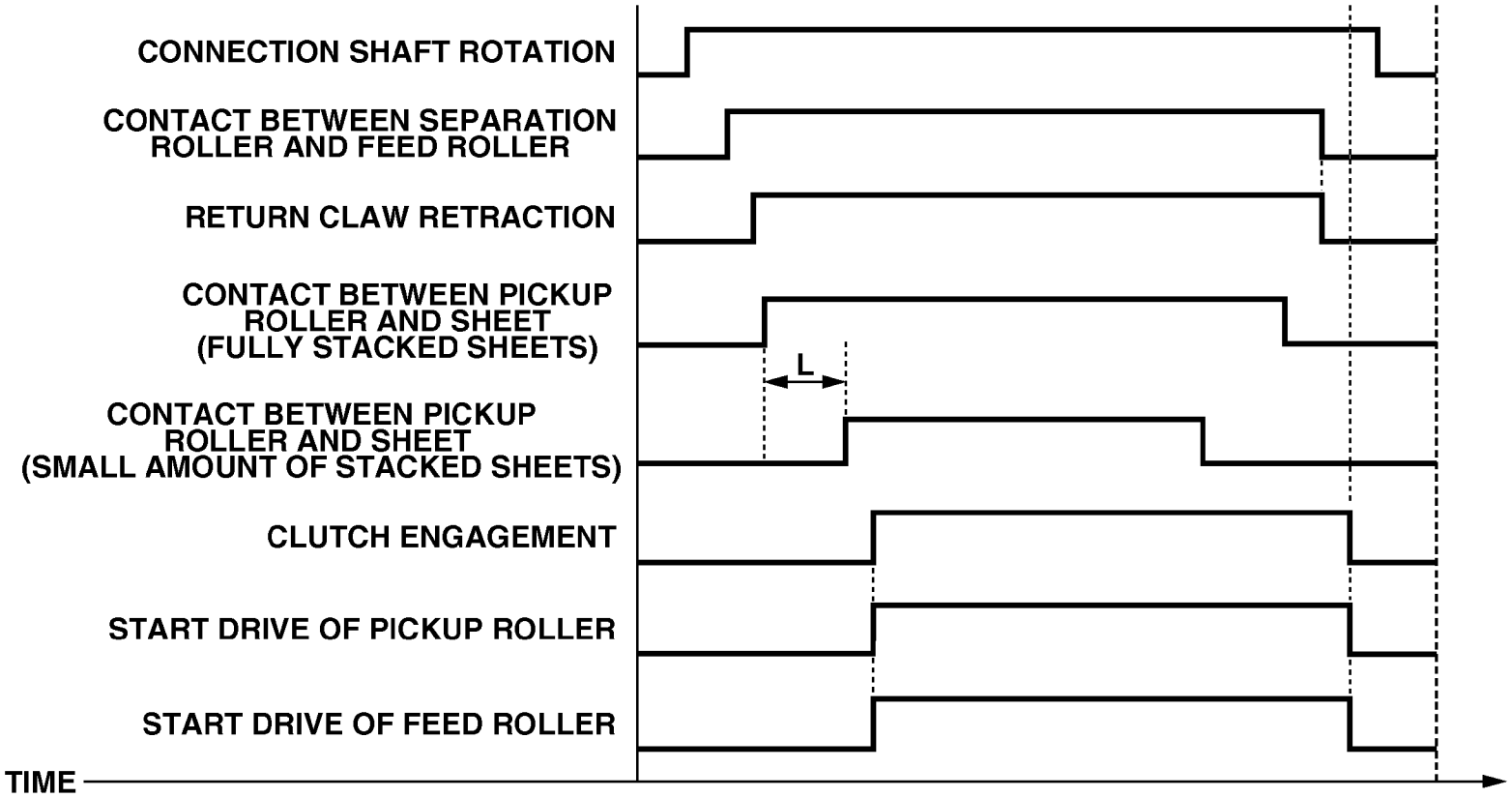
FIG. 13 is a timing chart illustrating a sheet feeding operation.

FIG. 13 is a timing chart illustrating a sheet feeding operation according to the present exemplary embodiment. A rising edge indicates the start of each operation, and a falling edge indicates the end of each operation.

When a sheet feeding signal is input to the control unit through a user's instruction, the control unit starts driving the driving source 21. At a predetermined timing based on a count value such as a timer, the above-described solenoid (not illustrated) is absorbed based on the electrical signal from the control unit, and the partially-toothless gear 24 engages with the second drive gear 23. Accordingly, the driving force of the driving source 21 is transmitted to the connecting shaft 20 via the partially-toothless gear 24, and the connecting shaft 20 starts rotating together with the elevation cams 19 (19L and 19R) and the clutch bearing 25. The connecting shaft gear 50 fixed to the connecting shaft 20 also starts rotating, and accordingly the separation control gear 49 starts rotating. When the separation control gear 49 rotates by a predetermined amount, the separation lever 47 rotates, and the separation roller 8 separated from the feed roller 7 comes into contact with the feed roller 7. Since the return claw control member 52 rotates in synchronization with the contact operation of the separation roller 8, the return claw 53 protruded to the sheet conveyance path is retracted from the sheet conveyance path. When the elevation cams 19 (19L and 19R) rotate, the elevation levers 18 also rotate, and the stacking plate 16 starts moving up and down via the engaging portions 17 engaging with the elevation levers 18. In this case, as illustrated in FIG. 13, a time lag L (refer to FIG. 13) occurs in the timing of contact between the sheet S and the pickup roller 6 according to the amount of sheets S stacked on the stacking plate 16.

In the present exemplary embodiment, even with a small amount of stacked sheets S, the cam plane 32 and the clutch regulation rib 33 allows the clutch unit 60 to be brought into the connected state after a timing of contact between the sheet on the stacking plate 16 and the pickup roller 6. Therefore, even when the sheet S contacts the pickup roller 6, sheet feeding is not started immediately but started when the clutch unit 60 is brought into the connected state, as illustrated in FIG. 13. More specifically, since the clutch unit 60 is connected to the connecting shaft 20 when the connecting shaft 20 is at a fixed position in one rotation, the sheet feed timing of the pickup roller 6 is fixed.

Therefore, even if a timing lag occurs in the timing of contact between the sheet S and the pickup roller 6, the interval of sheet feeding does not fluctuate because the sheet feed timing of the pickup roller 6 is fixed regardless of the amount of stacked sheets. After the end of one rotation operation of the connecting shaft 20, the clutch unit 60 is brought into the disconnected state by the cam plane 32 and the clutch regulation rib 33, resulting in the disconnected state of the clutch unit 60 illustrated in FIG. 7A. In this case, to reduce operation sound, the clutch unit 60 is configured to start to be disconnected as illustrated in FIG. 7C at a timing after the separation roller 8 separates from the feed roller 7. This is because the clutch unit 60 is disconnected with the load torque of the separation roller 8 applied to the feed roller 7, thereby increasing the disconnection sound of the clutch unit 60. In the disconnected state of the clutch unit 60, since the pickup roller 6 and the feed roller 7 can be rotatably driven, a back tension is not applied to the sheet and therefore no conveyance resistance arises in the registration roller pair 11 on the downstream side. The sheet conveyance distance produced by the pickup roller 6 and the feed roller 7 can be freely set by using the speed reduction ratio of each of the clutch output gear 27 and the idler gear 31 and the speed reduction ratio by the diameter of each roller with respect to one rotation of the connecting shaft 20. Therefore, even when the configuration according to the present exemplary embodiment is used to prevent fluctuation in the interval of sheet feeding, it is not necessary to increase the outer diameters of the pickup roller 6 and the feed roller 7. As described above, according to the present invention, it is possible to reduce fluctuation in the interval of sheet feeding, which occurs according to the amount of stacked sheets, with an inexpensive configuration without increasing the size of the sheet feeding apparatus 10.

Although, with the configuration according to the above-described exemplary embodiment, the engagement between the partially-toothless gear 24 and the second drive gear 23 is controlled by a solenoid, the engagement may be controlled using an electromagnetic clutch.

Further, with the configuration according to the above-described exemplary embodiment, the clutch input gear 26 and the clutch output gear 27 are engaged with each other via a tooth plane shape. However, they may be configured to come into contact with each other via a friction member having a large sliding resistance.

Furthermore, in the above-described exemplary embodiment, a configuration in which one cam plane 32 and one clutch regulation rib 33 are provided is described. However, the clutch may be configured to be connected and disconnected a plurality of number of times according to the rotation of the clutch input gear 26 by providing a plurality of the cam planes 32 and the clutch regulation ribs 33.

Although, in the above-described first exemplary embodiment, the sheet feeding device including the pickup roller 6 and the feed roller 7 has a configuration in which the pickup roller 6 contacts the sheet on the stacking plate 16 and then the feed roller 7 contacts the separation roller 8, the present invention should not be limited thereto. More specifically, in the present invention, the sheet feeding device may be configured to be one roller having a large outer diameter.

Although the above-described first exemplary embodiment has a configuration in which the pickup roller 6 is fixed and the stacking plate 16 is moved up and down to bring the sheet stacked on the stacking plate 16 and the pickup roller 6 into contact with each other, the present invention should not be limited thereto. The present invention may have a configuration in which the stacking plate 16 is fixed and the pickup roller 6 is moved up and down.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-244172, filed Dec. 2, 2014, which is hereby incorporated by reference herein in its entirety.

What is claimed is:

1. A sheet feeding apparatus comprising:

a sheet feeding device configured to feed a sheet;

a separating member provided movably between a contact position where the separating member is in contact with the sheet feeding device and a separated position where the separating member is separated from the sheet feeding device, and configured to separate sheets;

a first moving device configured to move the separating member between the contact position and the separated position;

a driving device configured to generate a driving force; and a clutch unit configured to change a transmission state of the driving force from the driving device to the sheet feeding device between a first state where the driving force is transmitted and a second state where the driving force is not transmitted, wherein, after the first moving device moves the separating member from the contact position to the separated position, the clutch unit changes the transmission state of the driving force from the driving device to the sheet feeding device to the second state.

2. The sheet feeding apparatus according to claim 1, wherein the sheet feeding device comprises a pickup roller configured to feed a sheet by rotating while in contact with a stacked sheet, and a feed roller configured to feed the sheet fed by the pickup roller, and wherein the separating member contacts the feed roller.

3. The sheet feeding apparatus according to claim 2, further comprising:

a stacking unit on which sheets are stacked; and an elevation device configured to move the stacking unit up and down using the driving force of the driving device to bring a sheet stacked on the stacking unit into contact with the pickup roller.

4. The sheet feeding apparatus according to claim 1, wherein the first moving device moves the separating member between the contact position and the separated position using the driving force generated by the driving device.

5. The sheet feeding apparatus according to claim 1, further comprising:

an urging member configured to urge the separating member toward the sheet feeding device, wherein the first moving device moves the separating member from the contact position to the separated position against the urging force of the urging member.

6. The sheet feeding apparatus according to claim 1, further comprising:

a protruded member protruded to a sheet conveyance path between the separating member and the sheet feeding device; and a second moving device configured to move the protruded member between a protruded position where the protruded member is protruded to the sheet conveyance path and a retracted position where the protruded member is retracted from the protruded position, wherein, in conjunction with an operation of the first moving device for moving the separating member from the contact position to the separated position, the second moving device moves the protruded member to the protruded position.

7. The sheet feeding apparatus according to claim 6, wherein the protruded member is provided at a position different from the separating member in a direction perpendicularly intersecting with a sheet feeding direction.

8. The sheet feeding apparatus according to claim 6, wherein the second moving device moves the protruded member using the driving force of the driving device.

9. The sheet feeding apparatus according to claim 1, wherein, after bringing a sheet stacked on the stacking unit into contact with the sheet feeding device, the clutch unit changes the transmission state of the driving force from the driving device to the sheet feeding device to the first state.

10. The sheet feeding apparatus according to claim 1, wherein the clutch unit includes:

a clutch input unit configured to receive a driving force of the driving device to rotate;

a clutch output unit configured to connect with the clutch input unit to transmit the driving force from the driving device to the pickup roller; and a clutch regulation device configured to move the clutch input unit between a disconnected position where the clutch input unit is disconnected with the clutch output unit and an connected position where the clutch input unit is connected with the clutch output unit.

11. The sheet feeding apparatus according to claim 10, wherein the elevation device is a stacking unit elevation device configured to move the stacking unit up and down, wherein the stacking unit elevation device comprises:

a connecting shaft configured to rotate by a driving force received from the driving device; and an elevation cam configured to move the stacking unit up and down as the connecting shaft rotates, and wherein, in synchronization with the rotation of the connecting shaft, the clutch input unit moves between the disengaged position and the engaged position while the connecting shaft rotates once.

12. The sheet feeding apparatus according to claim 10, wherein the clutch regulation device comprises:

a cam plane provided at the clutch input unit;

an elastic member configured to urge the clutch input unit toward the clutch output unit; and a clutch regulation rib configured to latch the clutch input unit at the disengaged position as the cam plane urged by the elastic member comes into contact with the clutch regulation rib, and wherein, when the driving device is driven and the clutch input unit rotates, the cam plane is unlatched by the clutch regulation rib, thereby causing the clutch input unit to move from the disengaged position to the engaged position, and, when the clutch input unit further rotates, the cam plane is latched again by the clutch regulation rib, thereby causing the clutch input unit to move from the engaged position to the disengaged position.

13. The sheet feeding apparatus according to claim 10, wherein the first moving device starts separating the separating member from the sheet feeding device at a timing before the clutch input unit moves to the disengaged position.

14. The sheet feeding apparatus according to claim 1, further comprising:

a conveyance device provided on a downstream side of the separating member in a sheet feeding direction, wherein, after a leading edge of the sheet reaches the conveyance device, the first moving device moves the separating member from the contact position to the separated position.

15. An image forming apparatus comprising:

a sheet feeding device configured to feed a sheet;

an image forming unit configured to form an image on the sheet fed by the sheet feeding device;

a separating member movably provided between a contact position where the separating member is in contact with the sheet feeding device and a separated position where the separating member is separated from the sheet feeding device, and configured to separate sheets;

a first moving device configured to move the separating member between the contact position and the separated position;

a driving device configured to generate a driving force; and a clutch unit configured to change a transmission state of the driving force from the driving device to the sheet feeding device between a first state where the driving force is transmitted and a second state where the driving force is not transmitted, wherein, after the first moving device moves the separating member from the contact position to the separated position, the clutch unit changes the transmission state of the driving force from the driving device to the sheet feeding device to the second state.

* * * * *